US007239872B2

(12) United States Patent
Ohaku et al.

(10) Patent No.: US 7,239,872 B2
(45) Date of Patent: Jul. 3, 2007

(54) SYSTEM FOR ENABLING A HIGH-SPEED MOVING VEHICLE TO COMMUNICATE WITH BASE STATIONS

(75) Inventors: Shigeo Ohaku, Kawasaki (JP); Hiroyuki Murakami, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 325 days.

(21) Appl. No.: 10/918,074

(22) Filed: Aug. 13, 2004

(65) Prior Publication Data

US 2005/0208924 A1 Sep. 22, 2005

(30) Foreign Application Priority Data

Mar. 17, 2004 (JP) ..... 2004-076625

(51) Int. Cl.
*H04Q 7/20* (2006.01)
*H04B 1/06* (2006.01)

(52) U.S. Cl. ..... 455/434; 455/345; 455/152.1

(58) Field of Classification Search ..... 455/432.1, 455/434, 435.1, 435.2, 440, 441, 450, 456.1, 455/464, 561, 562.1, 345, 351, 152.1, 422.1
See application file for complete search history.

(56) References Cited

U.S. PATENT DOCUMENTS 5,577,264 A * 11/1996 Tuohino ..... 455/432.1
5,924,033 A * 7/1999 Carlsson et al. ..... 455/436
5,970,408 A * 10/1999 Carlsson et al. ..... 455/439
6,791,475 B2 * 9/2004 Yamashita ..... 340/935
6,909,893 B2 * 6/2005 Aoki et al. ..... 455/422.1
6,987,978 B2 * 1/2006 Masuda et al. ..... 455/456.4
7,072,654 B2 * 7/2006 Fujiwara et al. ..... 455/435.1
7,096,000 B2 * 8/2006 Yano ..... 455/345
2002/0077122 A1 * 6/2002 Yule ..... 455/456
2002/0147023 A1 * 10/2002 Sawada et al. ..... 455/456
2003/0013445 A1 * 1/2003 Fujiwara et al. ..... 455/435
2004/0203911 A1 * 10/2004 Masuda et al. ..... 455/456.1
2005/0197121 A1 * 9/2005 Fujiwara et al. ..... 455/435.1

FOREIGN PATENT DOCUMENTS

JP 2001-204066 7/2001
JP 2002-033694 1/2002

* cited by examiner

*Primary Examiner*—Sonny Trinh
(74) *Attorney, Agent, or Firm*—Katten Muchin Rosenman LLP

(57) ABSTRACT

A communication system is disclosed including a backbone network, a moving vehicle further including a vehicle selection unit, an array of base stations connected to the backbone network, and a station selection unit provided to the array of base stations. The moving vehicle transmits upstream data to the array of base stations using an upstream signal frequency uniquely allocated to the moving vehicle, the upstream data being addressed to the backbone network. The station selection unit, if the upstream data is received redundantly, discards the redundantly-received upstream data, and transfers the upstream data to the backbone network. The array of base stations transmits downstream data received from the backbone network to the moving vehicle using a downstream signal frequency common to the array of base stations. The vehicle selection unit selects the downstream data addressed to the moving vehicle.

26 Claims, 8 Drawing Sheets

FIG.5

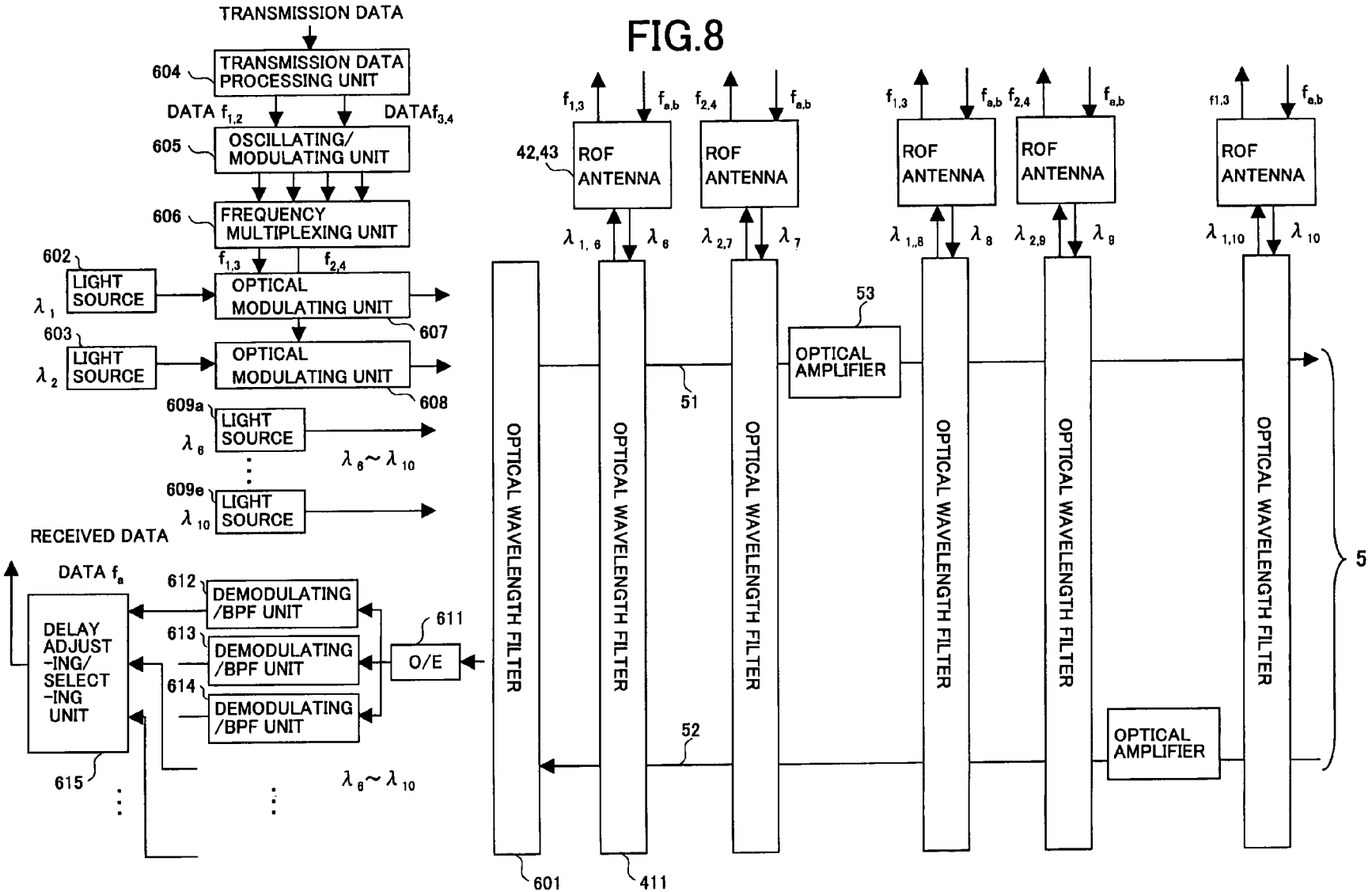
FIG.8
5
ROF ANTENNA
42,43
OPTICAL WAVELENGTH FILTER
OPTICAL AMPLIFIER
53
51
52
411
601
611
O/E
TRANSMISSION DATA
TRANSMISSION DATA PROCESSING UNIT
604
DATA $f_{1,2}$
DATA $f_{3,4}$
OSCILLATING/ MODULATING UNIT
605
FREQUENCY MULTIPLEXING UNIT
606
OPTICAL MODULATING UNIT
607
608
LIGHT SOURCE
602
603
609a
609e
$\lambda_1$
$\lambda_2$
$\lambda_8$
$\lambda_{10}$
$\lambda_6 \sim \lambda_{10}$
DEMODULATING /BPF UNIT
612
613
614
RECEIVED DATA
DATA $f_a$
DELAY ADJUST -ING/ SELECT -ING UNIT
615

SYSTEM FOR ENABLING A HIGH-SPEED MOVING VEHICLE TO COMMUNICATE WITH BASE STATIONS

BACKGROUND OF THE INVENTION

1. Field of the Invention

The present invention generally relates to a communication system, and more particularly, to a system for enabling a high-speed moving vehicle such as a train or an automobile to communicated with a base station.

2. Description of the Related Art

The communication between moving trains and automobiles is conventionally supported by leakage coaxial cable and sky wave. Japanese Patent Laid-Open Application No. 2002-33694, for example, discloses a wireless communication system that enables a moving vehicle to stably communicate with a base station, the system withstanding fading, shadowing, and phase noise. Japanese Patent Laid-Open Application No. 2001-204066, for example, discloses a system that enables a moving vehicle to communicate with a series of base stations arranged along a road.

The leakage coaxial cable is used for the communication between, for example, a super express train and the base station, and provides stable communication. The bandwidth of the leakage coaxial cable, however, is not wide enough to support high-speed communication. For this reason, it is rather difficult to provide passengers with better communication environment and to support smooth communication between staff on board and ground staff.

In addition, conventional wireless LAN technology requires high-speed handing over. That is, a moving vehicle at high speed needs to be handed over quickly from base station to base station. The high-speed handing over often fails due to various obstacles, which results in, for example, disconnection of the communication.

SUMMARY OF THE INVENTION

Accordingly, it is a general object of the present invention to provide a novel and useful communication system in which one or more of the problems described above are eliminated.

Another and more specific object of the present invention is to provide a communication system that enables a vehicle moving at high speed to stably communicate with base stations on the ground via broad band.

To achieve at least one of the above objects, a communication system for communicating signals between a moving vehicle and a backbone network via an array of base stations, according to the present invention may include:

a vehicle selection unit and a base station selection unit;

wherein the vehicle selection unit transmits upstream data addressed to the backbone network from the moving vehicle to one or more of the base stations of the array; and wherein the base station selection unit receives the upstream data transmitted to the one or more base stations and determines whether the same upstream data was received redundantly by two or more of the base stations, and discards said redundantly-received upstream data, and transmits the upstream data to the backbone network.

According to another aspect of the present invention, a communication system for communicating signals between a moving vehicle and a backbone network via an array of base stations may include:

a vehicle selection unit and a base station selection unit;

wherein the base station selection unit transmits downstream data addressed to the moving vehicle from the backbone network to one or more of the base stations of the array; and wherein the vehicle selection unit receives the downstream data from the one or more base stations and determines whether other downstream data addressed to other moving vehicles was also transmitted to the vehicle selection unit by the one or more base stations, and discards said other downstream data and selects the downstream data addressed to the moving vehicle.

Accordingly, the system according to the present invention can enable the moving vehicle to communicate with the array of base stations without handing-over operation.

According to another aspect of the present invention, a service area of the system may be divided into a plurality of areas, and the upstream signal frequency and the downstream signal frequency may be allocated by the area.

Accordingly, the frequencies can be allocated efficiently.

According to yet another aspect of the present invention, the communication system may further include an inter-base station network provided along a moving path of the moving vehicle, wherein the base stations of the array are arranged at a predetermined interval.

Accordingly, the system can cover the entire service area.

According to yet another aspect of the present invention, the station selection unit may adjust delay in signal transmission due to difference in distance between the base stations of the array and the station selection unit.

Accordingly, the communication system can maintain the quality of service substantially at a constant level even for service such as moving pictures and audio data that requires real-time data transmission.

According to yet another aspect of the present invention, each of the base stations of the array may further include a wavelength division multiplexer that exchanges optical signals having a wavelength allocated to the base station, with the inter-station network; a directional antenna; and a ROF unit that outputs electromagnetic wave contained in the optical signal to the antenna, and converts signal received from the antenna to an optical signal.

Accordingly, the base stations can be configured with only passive devices that requires no electric power supply.

Other objects, features, and advantages of the present invention will be more apparent from the following detailed description when read in conjunction with the accompanying drawings.

BRIEF DESCRIPTION OF THE DRAWINGS

FIG. 5 is a data diagram showing the configuration of a packet that is processed by a selection unit according to an embodiment;

FIG. 8 is a block diagram showing a network connecting the base stations according to an embodiment.

DETAILED DESCRIPTION OF THE PREFERRED EMBODIMENTS

Preferred embodiments of the present invention are described with reference to the drawings. In the following embodiments, an assumption is made that the moving vehicles are trains traveling on a railway. However, those skilled in the art will recognize that, according to another embodiment, the moving vehicles may be automobiles running on a highway.

Figure 1:
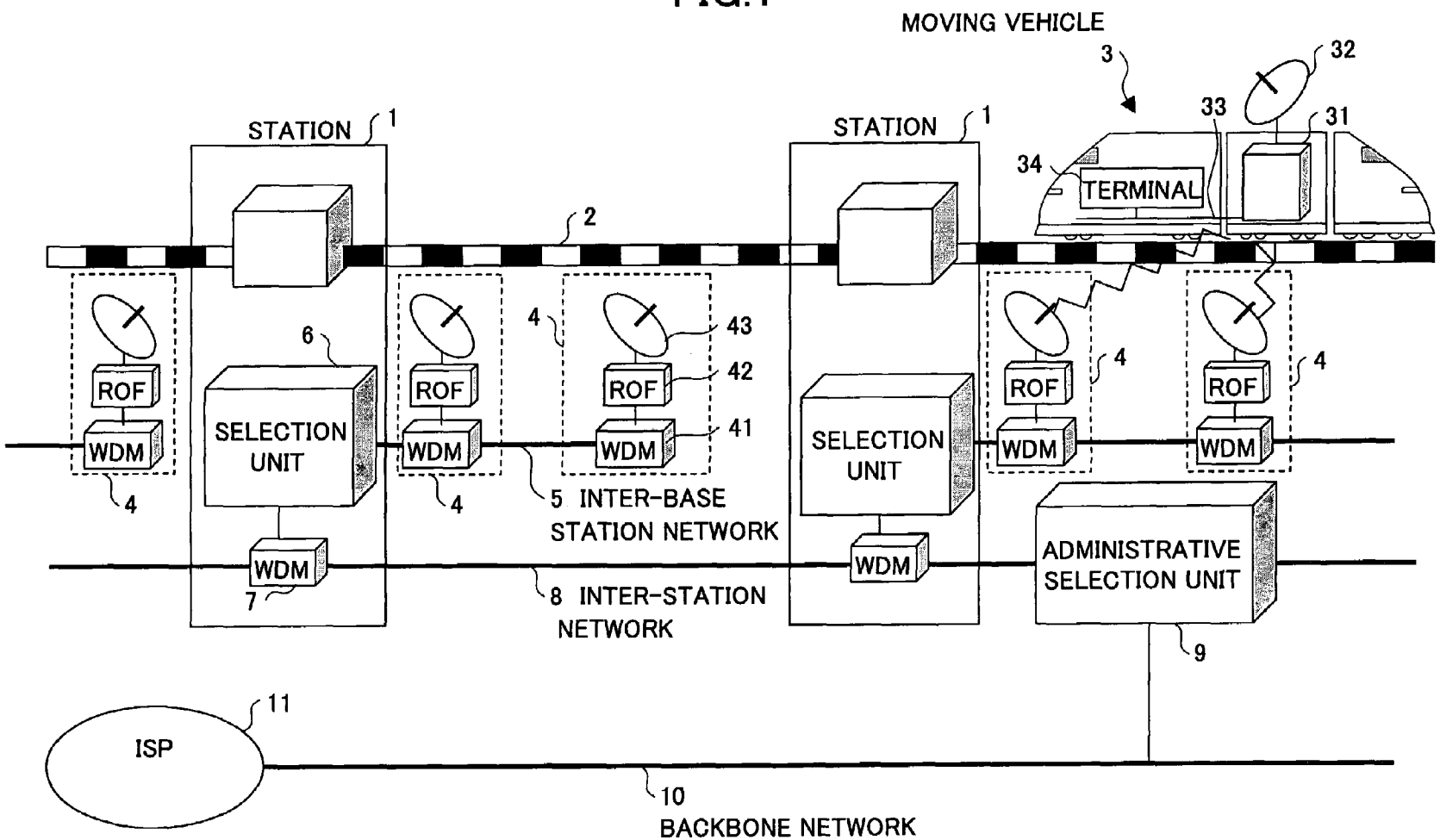
FIG. 1 is a schematic diagram showing a communication system according to an embodiment of the present invention.

FIG. 1 is a schematic diagram showing a communication system according to an embodiment. As shown in FIG. 1, a moving vehicle 3 travels on a railway 2. There are provided multiple stations 1 on the railway 2. The moving vehicle 3 is provided with an antenna 32 and a vehicle selection unit 31. The vehicle selection unit 31 transmits data (packet) to and receives data from a base selection unit via the antenna 32, selects relevant packets, and discards redundant packets, for example. The vehicle selection unit 31 is connected to an intra-vehicle network 33. Passengers and staff use terminals 34 connected to the intra-vehicle network 33. According to an embodiment, the intra-vehicle network 33 may be wire-transferred. According to another embodiment, the intra-vehicle network 33 may be wireless.

An inter-base station network 5 is provided along the railway 2. The inter-base station network 5 is divided into multiple areas, and multiple base stations 4 are provided in each area at a predetermined interval. The base station 4 is provided with a Wavelength Division Multiplexing (WDM) unit 4 and a Radio On Fiber (ROF) unit 42. The WDM unit 4 exchanges optical signals, the wavelength of which is allocated to the WDM unit 4, with the inter-base station network 5. The ROF unit 42 separates and outputs radio frequency signals contained in the optical signal as a radio wave to an antenna 43, and generates an optical signal based on a radio wave signal received by the antenna 43. The antenna 43 is directional to the moving direction of the moving vehicle 3.

A base station selection unit 6 is provided at an end of the inter-base station network 5. The base station selection unit 6 selects packets and discards redundant packets. The base station selection unit 6 is connected to an inter-station network 8 via a Wavelength Division Multiplexing (WDM) unit 7. An administrative selection unit 9 is provided to the inter-station network 8. The administrative selection unit 9 administers the base station selection units 6. The administrative selection unit 9 is connected to a backbone network 10, and further connected to an Internet Service Provider (ISP) 11 via the backbone network 10.

Figure 2:
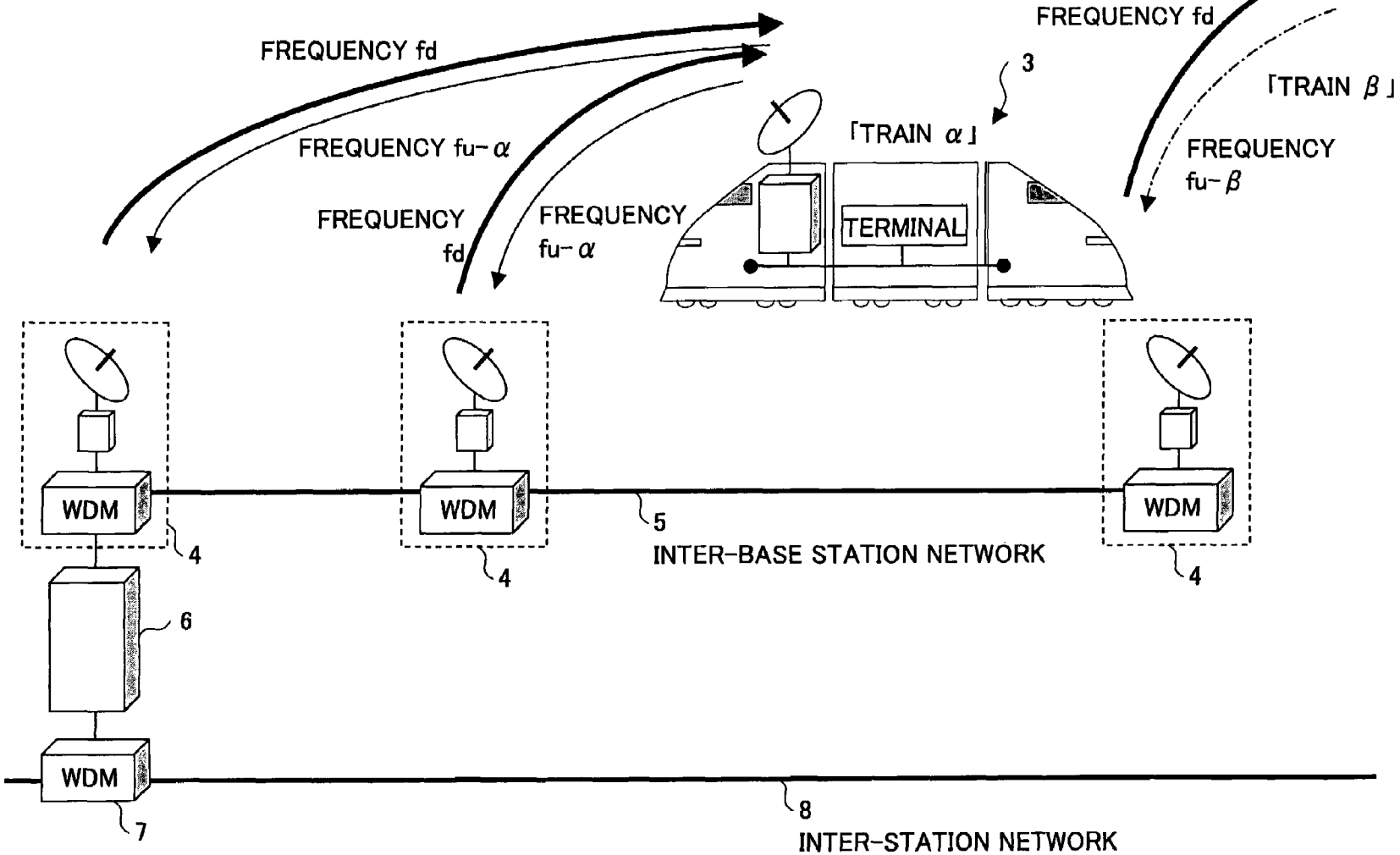
FIG. 2 is a schematic diagram showing the interface between a moving vehicle and base stations according to an embodiment of the present invention.

FIG. 2 is a schematic diagram showing the interface between the moving vehicle 3 and the base stations 4. The area covered by the system, for example the area along the railway, is divided into multiple areas. When a signal is sent from one of the base stations 4 to the moving vehicle 3 (down stream), a common frequency fd is used. When a signal is sent from the moving vehicle 3 to the base stations 4 (up stream), a frequency allocated to the specific moving vehicle 3 is used. For example, a train $\alpha$ may use a frequency fu-$\alpha$, and another train $\beta$ may use a frequency fu-$\beta$. In the case of trains in which their positions are known based on a predetermined schedule, different frequencies are required for a preceding train and a following one, and for an inbound train and an outbound one, for example. As a result, four different frequencies in total may suffice. According to an embodiment, different frequencies may be allocated to the trains traveling in another area. According to another embodiment, if a sufficient bandwidth is provided to each frequency, the same frequency may be allocated to the up stream signals regardless of the area. The frequency of the down stream signals may be fixed regardless of the area subject to a sufficient bandwidth being provided to each frequency.

If different frequencies are used for different areas, the frequency can be switched while the train is making a stop at a station, or a buffer interval in which multiple frequencies can be used can be provided in order to avoid any instant discontinuity.

Figure 3:
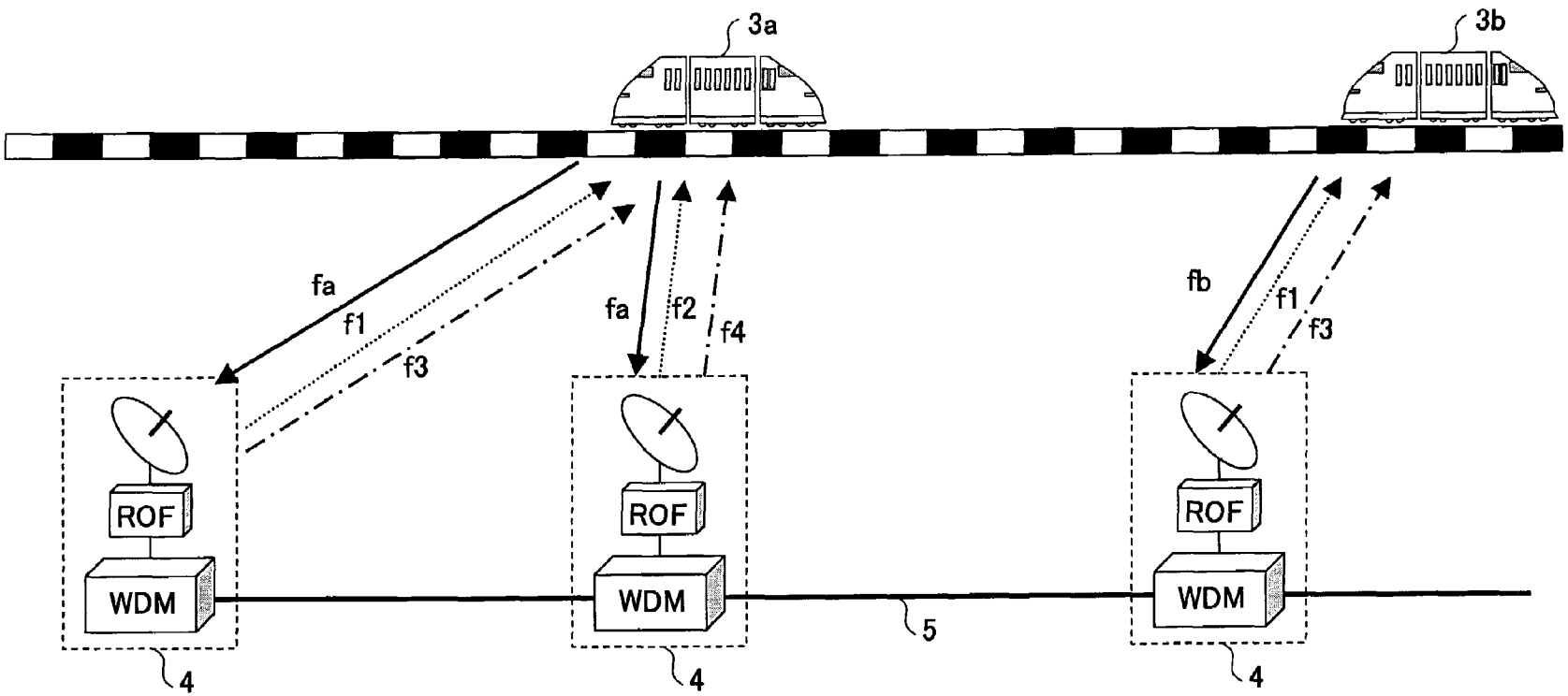
FIG. 3 is a schematic diagram showing the allocation of frequencies according to an embodiment of the present invention.

FIG. 3 is a schematic diagram for explaining allocation of frequencies according to an exemplary embodiment. Among frequencies f1, f2, f3, and f4 that can be allocated to downstream transmission from a base station 4 to a moving vehicle 3 (3*a* and 3*b* in this embodiment), a pair of f1 and f3 and a pair of f2 and f4 are allocated alternately so as not to cause interference between adjacent base stations 4. It is noted that a pair of two different frequencies may be used for the communication with a single base station, for example, when the broadband communication requires a wide bandwidth, such as may be the case in a broadband communication. If a single frequency can provide a bandwidth wide enough to support broadband communication, a single frequency may be allocated to each base station. Of course, if two frequencies cannot provide a bandwidth wide enough to support a broadband communication, three or more frequencies may be allocated to each base station, as necessary or desired. As is illustrated in FIG. 3, a frequency fa is allocated to the up stream communication from the moving vehicle 3*a* to the base stations 4, and another frequency fb is allocated to the up stream communication from the moving vehicle 3*b* to the base stations 4.

Figure 4:
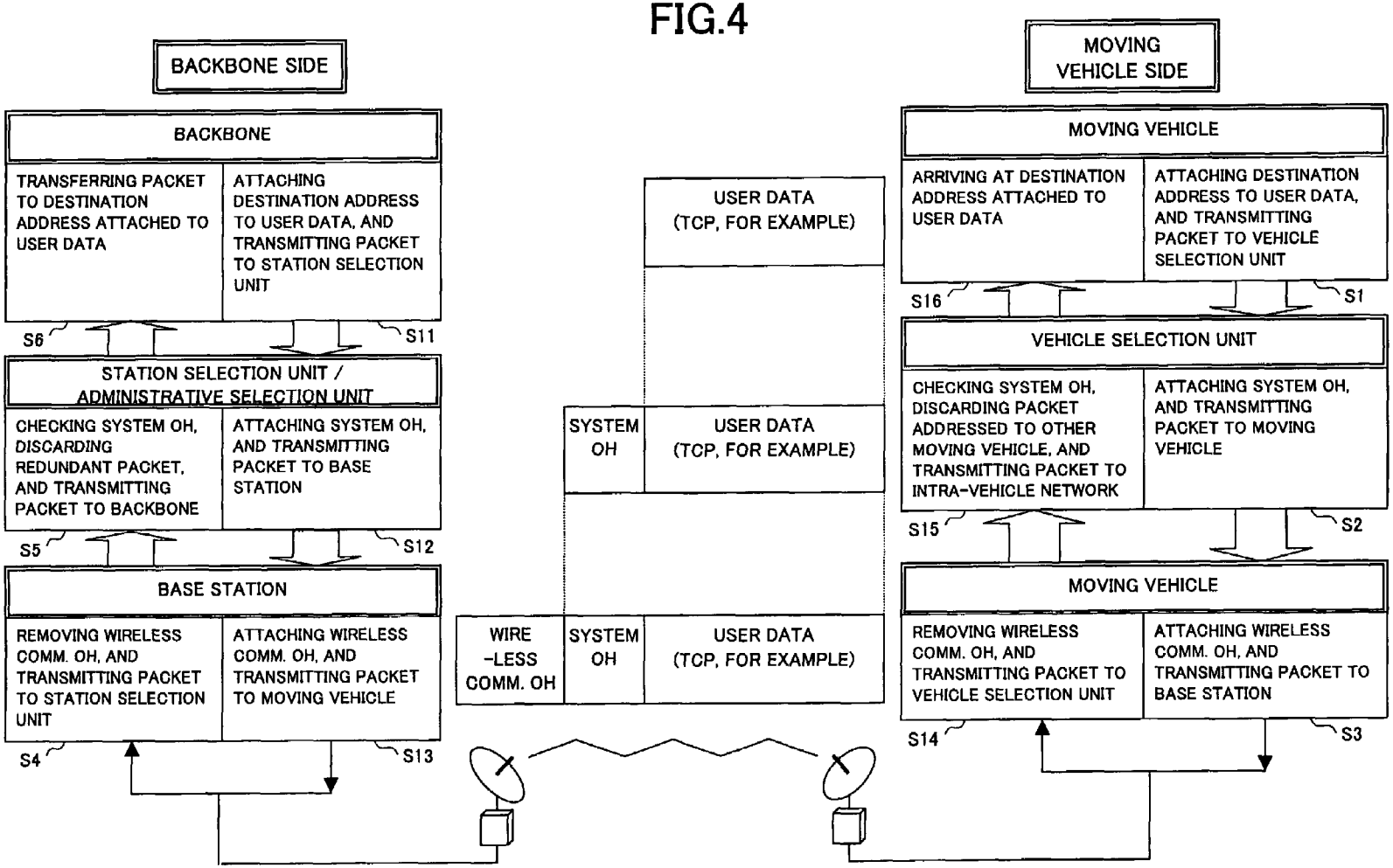
FIG. 4 is a diagram for explaining data transmission and reception between a moving vehicle and a backbone according to an embodiment.

FIG. 4 is a diagram for explaining data transmission and reception. It is assumed that the terminal 34 of the moving vehicle 3 (see FIG. 1) and a server (not shown) connected to the backbone network 10 communicate. It is further assumed in the following description that the terminal 34 and the server connected to the backbone network 10 communicate using Internet Protocol (IP). However, protocols other than the IP may be used, as will be appreciated. In addition, no description will be given about the sequence of protocols of upper layers other than the IP.

The up stream communication sequence (from the moving vehicle 3 to the base stations 4) is described first.

When the terminal 34 sends a packet to the server connected to the backbone network 10, the IP address of the server, for example, is attached to the packet as a destination address. Then, the packet (IP packet) is transmitted to the intra-vehicle network 33. An assumption is made that different intra-vehicle networks 33 use different address systems.

If a layer 3 switch (L3 SW) (not shown) in the intra-vehicle network 33 determines that the packet is addressed to an entity outside of the moving vehicle 3, the layer 3 switch transfers the packet to the vehicle selection unit 31 (step S1).

The vehicle selection unit 31 encapsulates the packet by attaching a system overhead (OH) to the original IP packet, the system overhead being a header of the system. FIG. 5 is a data diagram showing the configuration of the encapsulated packet. The encapsulated packet 100 includes the system overhead 101, user data 105 (TCP packet, for example), and a FCS 106. The system overhead 101 includes a moving vehicle ID 102, a sequence number 103, and a packet length 104. The moving vehicle ID 102 is a unique ID for identifying the moving vehicle 3. The sequence number 103 indicates the order in which the packets that are transmitted to the backbone network via the vehicle selection unit 31. The packet length 104 indicates the data length of each packet. The FCS 106 is used by a receiving side for checking the normality of the packet.

Returning to FIG. 4, the vehicle selection unit 31 transfers the encapsulated packet to the antenna 32 (step S2).

An additional overhead is attached to the packet for wireless communication, and the encapsulated packet is converted into a wireless signal and transmitted to the base stations 4 from the antenna 32 at the moving vehicle side to the antenna 43 at the base station side (step S3).

In response to receipt of the wireless signal from the moving vehicle 3, the base station 4 restores the encapsulated packet by converting the wireless signal and removing the overhead attached for wireless communication. The encapsulated packet is transferred to the base station selection unit 6 (step S4).

In response to reception of the encapsulated packet, the base station selection unit 6 checks the header and FCS attached by the vehicle selection unit 31, and detects communication error, if any. After ensuring that the packet is normal, the base station selection unit 6 identifies the packets having the same moving vehicle ID, and checks their sequence numbers. The base station selection unit 6 can determine, based on the moving vehicle ID and the sequence numbers, whether there is any missing packet or any redundant (sent twice or more) packets and discards such twice-sent redundant packets.

The base stations 4 are located so that the area that is covered by the antenna 43 of a base station 4 at least partially overlaps the area that is covered by the antenna 43 of a next base station 4, and the antennas 43 of the base stations 4 leave no part of the area along the railway in the illustrated exemplary embodiment uncovered. According to such arrangement, the packet transmitted by the moving vehicle 3 may be received in a redundant manner by multiple base stations 4. The base station selection unit 6 selects one of the packets among the multiple-received packets from the respective multiple base stations 4 and discards redundant packets.

The base station selection unit 6 transmits the selected packet to the administrative selection unit 9 on the inter-station network 8. The administrative selection unit 9 operates as the gateway to the backbone network 10 connected to the external Internet service provider (ISP) 11.

The administrative selection unit 9 processes the packet received from the base station selection units 6 in the same manner as the base station selection unit 6, and discards redundant packets between the inter-base station networks 5. The administrative selection unit 9 removes the system overhead from the received and selected packets, and transmits the packets to the backbone network 10 as the IP packets (step S5).

The packet is transferred via the backbone network 10 to the address attached to the user data (step S6).

The down stream communication (from the base station 4 to the moving vehicle 3) is described below.

It is assumed that an IP packet is returned from the ISP 11 to the terminal 34 in the moving vehicle 3. The address of the terminal 34 in the moving vehicle 3 is attached to the IP packet. The IP packet is transmitted from the ISP 11 to the administrative selection unit 9 via the backbone network 10.

The administrative selection unit 9 attaches a system overhead to the received IP packet thereby to encapsulate the IP packet. The system overhead includes a moving vehicle ID containing a destination address corresponding to the terminal address. A sequence number and a FCS are further attached to the IP packet. The sequence number indicates the order of the packets transmitted to the intra-vehicle network 33. The FCS is used for checking the normality of the packet at the receiving side. The administrative selection unit 9 transmits the encapsulated packets to the base station selection units 6 (step S11) under the administrative selection unit 9.

The base station selection unit 6 receives the packets from the administrative selection unit 9, and transfers the received packets to the base stations 4 via the inter-base station network 5 (step S12).

The encapsulated packet is provided with a wireless communication overhead, and transmitted to the moving vehicle 3 via the antenna 43 of the base station 4 using a single frequency (for example, fd in FIG. 2), or multiple frequencies (for example, f1 and f3 in FIG. 3), allocated to the down stream communication (step S13). The same frequencies may be used for downstream communications to the moving vehicles 3. Since multiple frequencies may be allocated (FIG. 3), each moving vehicle 3 can secure a bandwidth wide enough for broadband communication.

The antenna 32 of the moving vehicle 3 receives data from the antenna 43 of the base station 4. The encapsulated packet is separated from the wireless communication overhead, and transferred to the moving vehicle selection unit 31 (step S14).

The moving vehicle selection unit 31 checks the system overhead contained in the encapsulated packet. The moving vehicle selection unit 31 determines based on the moving vehicle ID whether the packet is addressed to the intra-vehicle network 33 of the moving vehicle 3. If the packet is not addressed to the intra-vehicle network 33, the packet is discarded. The moving vehicle selection unit 31 detects any communication error based on the FCS. If the packet is normal, the moving vehicle selection unit 31 checks the sequence number of the packet thereby to detect any packet loss or redundant packets.

The antennas 43 of the base stations 4 along the railway are arranged in a manner in which the areas covered by the antennas 43 overlap. According to such arrangement, there remains no area, for example along the railway, that is not covered by any antenna 43, and the moving vehicle 3 may receive the same packet from different antennas 43 (i.e., base stations 4) redundantly. The redundant packets are discarded by the moving vehicle selection unit 31. After processing the packet, the moving vehicle selection unit 31 transmits the packet to the intra-vehicle network 33 (step S15). The data is delivered to the terminal 34 (step S16).

As described above, the moving vehicle 3 communicates with the base stations 4 in an inter-base station network area using fixed frequencies (for example fd in FIG. 2, or f1, f2, f3, f4 in FIG. 3) in such area, and if the same packet is received more than once, redundant packets are discarded. Accordingly, the system according to an embodiment of the present invention does not require handing over of a signal from a moving vehicle 3 which may cause disconnection of communication.

Figure 6:
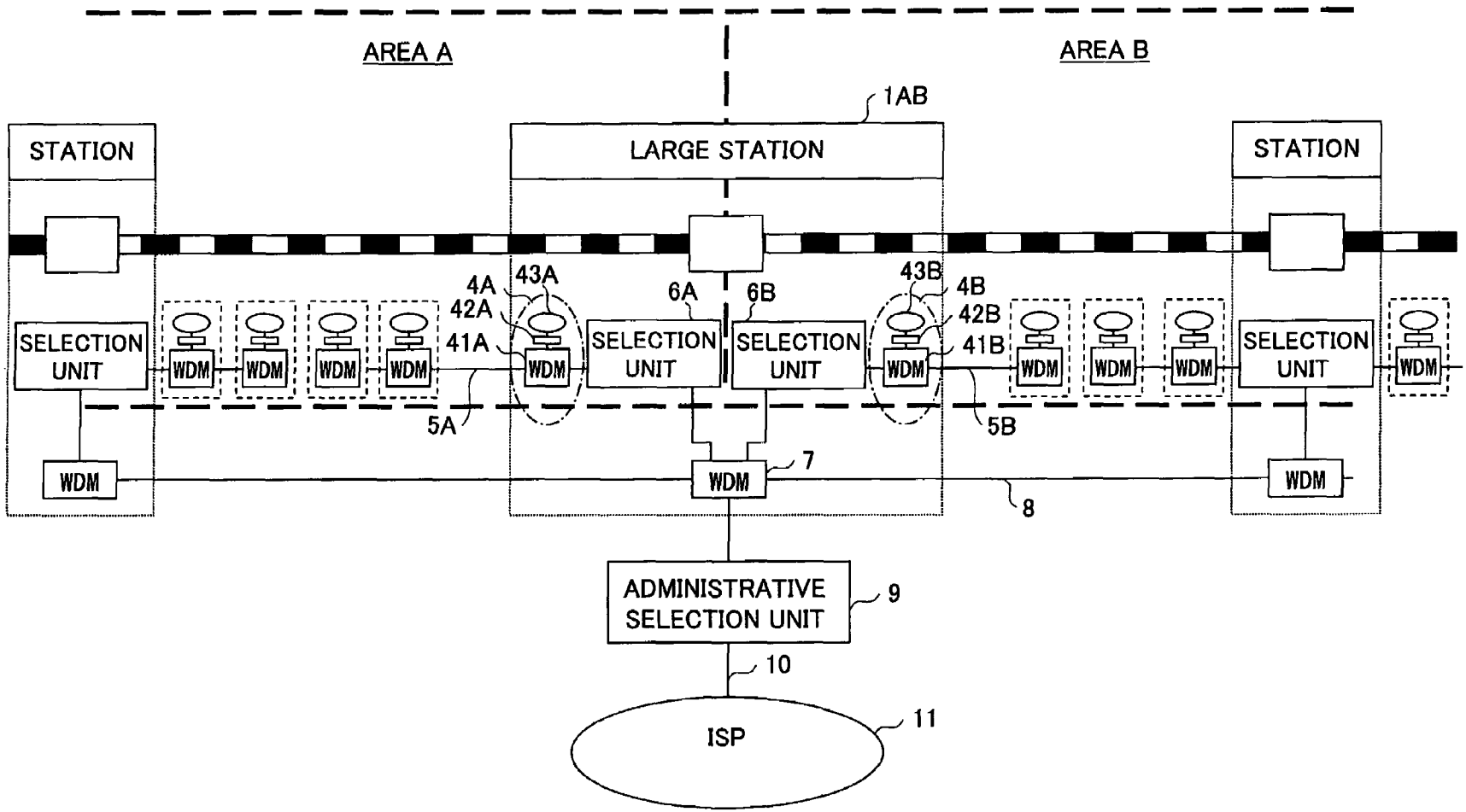
FIG. 6 is a schematic diagram showing a communication system in which the interference between areas in a large station is prevented according to an embodiment.

FIG. 6 is a schematic diagram showing a system according to an embodiment in which interference between areas is avoided at a large station. As shown in FIG. 6, a large station 1AB is located at the boundary between area A and area B, and a WDM unit 7 on an inter-station network 8 is provided to the large station 1AB. A base station selection unit 6A and a base station 4A are provided in the area A side of the large station 1AB. The base station selection unit 6A is connected to the WDM unit 7, and the base station 4A is connected to the base station selection unit 6A. The base station selection unit 6A is the terminal of an inter-base station network 5A. Similarly, a base station selection unit 6B and a base station 4B are provided in the area B side of the large station 1AB. The base station selection unit 6B is connected to the WDM unit 7, and the base station 4B is connected to the base station selection unit 6B. The base station selection unit 6B is the terminal of an inter-base station network 5B.

The base station 4A uses a Dedicated Short Range Communication (DSRC) technique, and includes a WDM 41A, a ROF unit 42A, and an antenna 43A. Similarly, the base station 4B uses a Dedicated Short Range Communication (DSRC) technique, and includes a WDM 41B, a ROF unit 42B, and an antenna 43B. When a moving vehicle arrives at the large station 1AB, the communication with the moving vehicle is switched to the DSRC technique.

The use of the DSRC technique in the large station 1AB prevents electro-magnetic waves emitted for communication in the area A, for example, from propagating to the area B, and vice versa. As a result, the interference between the base stations 4A and 4B, and further between the areas A and B, prevented.

Figure 7:
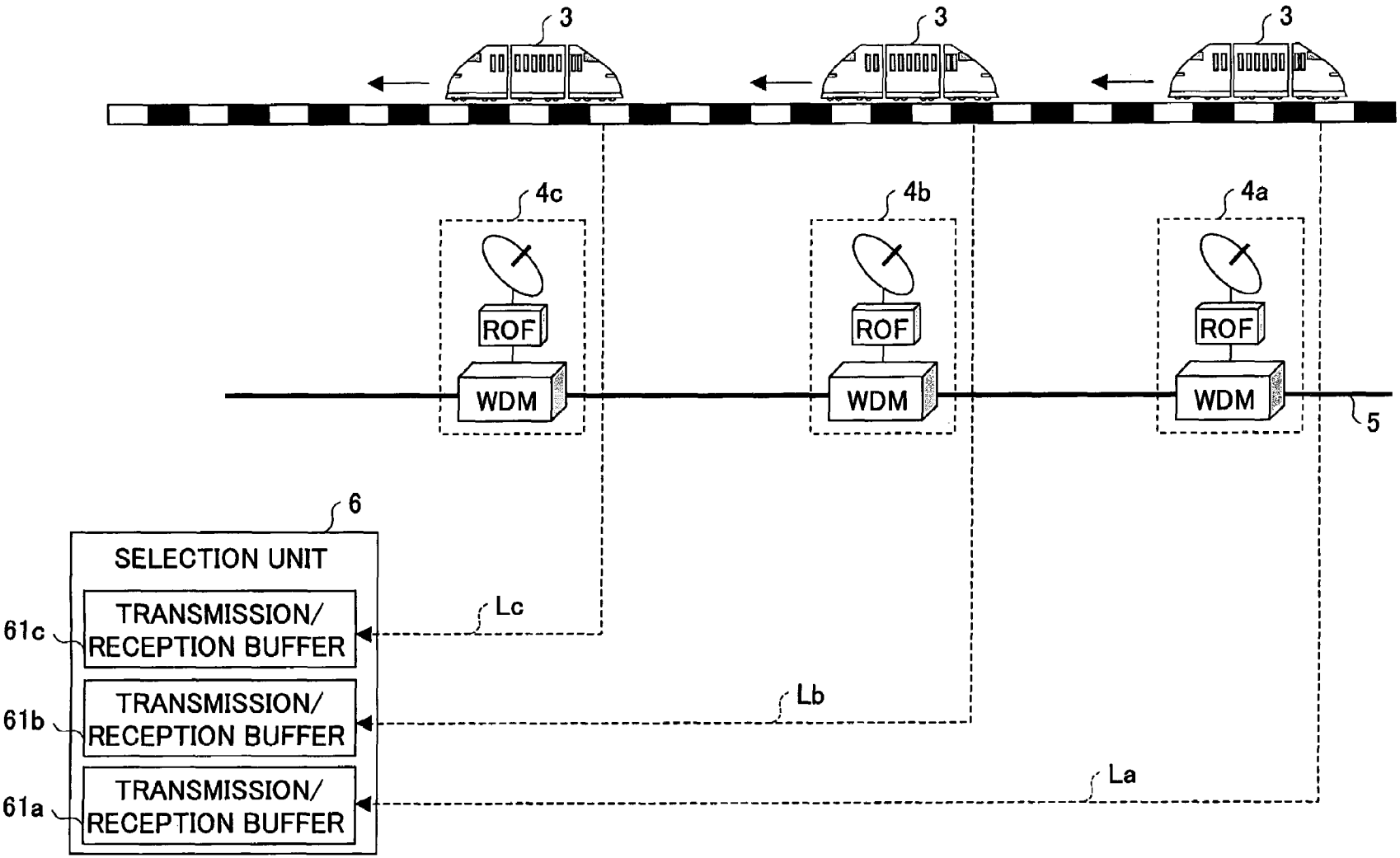
FIG. 7 is a schematic diagram for explaining the adjustment of delays according to an embodiment.

FIG. 7 is a schematic diagram for explaining delay adjustment according to an embodiment. A moving vehicle 3 travels on a railway, communicating with a series of base stations provided along the railway. As the moving vehicle 3 moves and communication is made from one base station to the next base station, the distance along the inter-base station network 5 between the respective base station with which the moving vehicle 3 is communicating and a base station selection unit 6 provided on the inter-base station network 5 changes. As a result, signals transferred through the inter-base station network 5 may require different time period to arrive at the base station selection unit 6. When a moving picture or an audio signal need to be transmitted, this change in time period may cause a delay problem, which may degrade the quality of service. Accordingly, the delay in the signal may need to be adjusted.

As shown in FIG. 7, when the moving vehicle 3 is communicating with a base station 4*a*, the signal needs to travel on the inter-base station network 5 for a distance La. Similarly, when the moving vehicle 3 is communicating with a base station 4*b*, the signal needs to travel on the inter-base station network 5 for a distance Lb, and when the moving vehicle 3 is communicating with a base station 4*c*, the signal needs to travel on the inter-base station network 5 for a distance Lc. The distances La, Lb, and Lc have the following relation: La>Lb>Lc. Whether the distance for which the signal transmitted from the base station with which the moving vehicle is communicating to the base station selection unit 6 increases or decreases depends on the direction in which the moving vehicle 3 moves and the direction in which the inter-base station network 5 extends. In general, when the moving vehicle 3 approaches the base station selection unit 6, which is the terminal of the inter-base station network 5, the distance for which the signal needs to travel is reduced. Similarly, when the moving vehicle 3 moves away from the base station selection unit 6, the distance for which the signal needs to travel increases.

The difference between the delays corresponding to the base stations 4 is reduced in the following manner in order to guarantee the quality of service.

The delay caused by the distance between a base station 4 and the base station selection unit 6 is computed based on the distance between them. The delay is regarded as a reference delay of the area. Since the base stations 4 are fixed in the illustrated embodiment, it is possible to obtain the difference in delay of the base stations 4. The delay in the area can be maintained substantially at a constant by adding the difference to the reference delay or subtracting the difference from the reference delay.

The base station selection unit 6 is provided with transmission/reception buffers 61*a*-61*c* corresponding to the respective base stations 4*a*-4*c*. The signal is retained in the transmission/reception buffers 61*a*-61*c* for a fixed reference delay. When the moving vehicle 3 approaches the base station selection unit 6, the signal is retained in the buffer for the difference in delay in addition to the fixed reference delay. Similarly, when the moving vehicle 3 moves away from the base station selection unit 6, the signal is retained in the buffer for the fixed reference delay minus the difference in delay. According to the above arrangements, the delay in the area can be maintained at the fixed reference delay.

The direction in which the moving vehicle 3 is moving can be recognized from the moving vehicle ID uniquely assigned to the moving vehicle 3 and time schedule of the moving vehicle 3.

According to another embodiment, the signal may be retained more than the fixed reference delay, that is, twice the fixed reference delay, for example. In this case, it takes more time for the signal to be transmitted, but the delay in signal can be maintained at a constant.

FIG. 8 is a block diagram showing the optical transmission of the inter-base station network 5 according to an embodiment. The ROF antennas 43 are provided along the railway at a predetermined interval. If the railway is long, many ROF antennas 43 may be needed to cover communication along the railway. In addition to the ROF antennas 43, many power supplies need to be provided along the railway. As a result, the ROF antennas 43 and the power supplies incur additional cost, require setting space, and consume additional power. To avoid such problems, the downstream signal may be transmitted to the base stations using a Radio On Fiber (ROF) method. If the ROF method is used, the base stations can be built with passive devices, and require no electric power supply.

As shown in FIG. 8, the inter-base station network 5 includes optical fibers 51 and 52 corresponding to downstream and upstream directions, respectively. The optical fibers 51 and 52 are terminated by an optical wavelength filter 601 provided in the station selection unit 6 (see FIG. 1). Multiple optical wavelength filters 411 of the wavelength division multiplexers 41 (see FIG. 1) of the base stations 4 are inserted along the optical fibers 51 and 52. An optical amplifier 53 may be inserted along the optical fibers 51 and 52, if necessary or desired.

Light sources 602 and 603 are used for downstream signal transmission from the base station to the moving vehicle. Optical signals of wavelengths λ1 and λ2 are alternately allocated to the base stations. Data to be transmitted is provided to optical modulating units 607 and 608 via a transmission data processing unit 604, an oscillating/modulating unit 605, and a frequency multiplexing unit 606. The optical modulating units 607 and 608 generate a signal by modulating, respectively, the optical signal λ1 of the light source 602 with frequencies f1 and f3, and the optical signal λ2 of the light source 603 with frequencies f2 and f4. Those signals are transmitted to the optical fiber 51 via the optical wavelength filter 601.

Light sources 609*a*-609*e* are used for upstream signal transmission from the moving vehicle to the base stations. Optical signals λ6-λ10 allocated to respective base stations are transmitted to the optical fiber 51 via the optical wavelength filter 601. For example, the optical signal λ6 is provided to the ROF unit 42 via the optical wavelength filter 411. The optical signal λ6 is modulated by frequency fa or fb received from the moving vehicle. The modulated optical signal λ6 is returned from the wavelength filter 411 via the optical fiber 52, and is provided to an optoelectronic converting unit 611. The optoelectronic converting unit 611 is provided for each wavelength. The input signal is further processed into received data by demodulating/band-pass filter units 612-614 and a delay adjustment/selection unit 615.

The present invention is not limited to these embodiments, but various variations and modifications may be made without departing from the scope of the present invention.

This patent application is based on Japanese priority patent application No. 2004-076625 filed on Mar. 17, 2004, the entire contents of which are hereby incorporated by reference.

What is claimed is:

1. A communication system for communicating signals between a moving vehicle and a backbone network via an array of base stations, the communication system comprising:

a vehicle selection unit and a base station selection unit;

wherein the vehicle selection unit transmits upstream data addressed to the backbone network from the moving vehicle to one or more of the base stations of the array; and wherein the base station selection unit receives the upstream data transmitted to the one or more base stations and determines whether the same upstream data was received redundantly by two or more of the base stations, and discards said redundantly-received upstream data, and transmits the upstream data to the backbone network.

2. The communication system as claimed in claim 1, wherein the vehicle selection unit transmits upstream data from the moving vehicle to one or more of the base stations of the array using an upstream signal frequency allocated to the moving vehicle.

3. The communication system as claimed in claim 1, wherein the base station selection unit determines whether the upstream data was sent two or more times by the vehicle selection unit, and discards said multiply-sent upstream data and selects the upstream data for transmission to the backbone network.

4. The communication system as claimed in claim 1, further comprising an inter-base station network connected to the base station selection unit, the inter-base station network transmitting upstream data from the one or more of the base stations of the array to the base station selection unit.

5. The communication system as claimed in claim 1, further comprising an administrative selection unit for administering the base station selection unit with respect to other base station selection units in the communication system.

6. The communication system as claimed in claim 1, further including an intra-vehicle network connected to the vehicle selection unit for transmitting data between the vehicle selection unit and terminals of the moving vehicle.

7. The communication system as claimed in claim 1, further including the array of base stations, wherein one or more of the base stations receives the upstream data transmitted from the vehicle selection unit using a radio on fiber method.

8. The communication system as claimed in claim 7, further comprising an inter-base station network connected to the base station selection unit, the inter-base station network transmitting upstream data from the one or more of the base stations of the array to the base station selection unit; and wherein each base station of the array of base stations includes:

a wavelength division multiplexer that exchanges with the inter-base station network optical signals having a wavelength allocated to the base station;

a directional antenna;

a radio on fiber unit that outputs electro-magnetic wave contained in the optical signal to the antenna, and converts signal received from the directional antenna to an optical signal.

9. A communication system for communicating signals between a moving vehicle and a backbone network via an array of base stations, the communication system comprising:

a vehicle selection unit and a base station selection unit;

wherein the vehicle selection unit transmits upstream data addressed to the backbone network from the moving vehicle to one or more of the array of base stations; and wherein the base station selection unit determines whether the upstream data was sent two or more times by the vehicle selection unit, and discards said multiply-sent upstream data and selects the upstream data for transmission to the backbone network.

10. A communication method for communicating signals between a moving vehicle and a backbone network via an array of base stations, the method comprising:

transmitting upstream data addressed to the backbone network from the moving vehicle to one or more of the base stations of the array;

receiving the upstream data transmitted to the one or more base stations and determining whether the same upstream data was received redundantly by two or more of the base stations;

discarding said redundantly-received upstream data; and transmitting the upstream data to the backbone network.

11. A communication method for communicating signals between a moving vehicle and a backbone network via an array of base stations, the method comprising:

transmitting upstream data addressed to the backbone network from a vehicle selection unit of the moving vehicle to one or more of the array of base stations; and determining whether the upstream data was sent two or more times by the vehicle selection unit;

discarding said multiply-sent upstream data; and selecting the upstream data for transmission to the backbone network.

12. A base station selection unit for use in a communication system, which communication system communicates signals between a vehicle selection unit of a moving vehicle and a backbone network via an array of base stations, the vehicle selection unit transmitting upstream data addressed to the backbone network from the moving vehicle to one or more of the base stations of the array, the base station selection unit comprising:

a receiving/transmitting unit that receives the upstream data transmitted to the one or more base stations and determines whether the same upstream data was received redundantly by two or more of the base stations, and discards said redundantly-received upstream data, and transmits the upstream data to the backbone network.

13. A base station selection unit for use in a communication system, which communication system communicates signals between a vehicle selection unit of a moving vehicle and a backbone network via an array of base stations, the vehicle selection unit transmitting upstream data addressed to the backbone network from the moving vehicle to one or more of the base stations of the array, the base station selection unit comprising:

a determining/selecting unit that determines whether the upstream data was sent two or more times by the vehicle selection unit, and discards said multiply-sent upstream data and selects the upstream data for transmission to the backbone network.

14. A communication system for communicating signals between a moving vehicle and a backbone network via an array of base stations, the communication system comprising:

a vehicle selection unit and a base station selection unit;

wherein the base station selection unit transmits downstream data addressed to the moving vehicle from the backbone network to one or more of the base stations of the array; and wherein the vehicle selection unit receives the downstream data from the one or more base stations and determines whether other downstream data addressed to other moving vehicles was also transmitted to the vehicle selection unit by the one or more base stations, and discards said other downstream data and selects the downstream data addressed to the moving vehicle.

15. The communication system as claimed in claim 14, wherein the vehicle selection unit receives the downstream data from the one or more base stations via a downstream signal frequency common to the array of base stations.

16. The communication system as claimed in claim 14, wherein the vehicle selection unit determines whether the same downstream data was received redundantly by two or more of the base stations, and discards said redundantly-received downstream data, and transmits the downstream data to the moving vehicle.

17. The communication system as claimed in claim 14, further comprising an inter-base station network connected to the base station selection unit, the inter-base station network routing downstream data from base station selection unit to the one or more of the base stations of the array.

18. The communication system as claimed in claim 14, further comprising an administrative selection unit for administering the base station selection unit with respect to other base station selection units in the communication system.

19. The communication system as claimed in claim 14, further including an intra-vehicle network connected to the vehicle selection unit for transmitting data between the vehicle selection unit and terminals of the moving vehicle.

20. The communication system as claimed in claim 14, further including the array of base stations, wherein one or more of the base stations transmits the downstream data to the vehicle selection unit using a radio on fiber method.

21. A communication system for communicating signals between a moving vehicle and a backbone network via an array of base stations, the communication system comprising:

a vehicle selection unit and a base station selection unit;

wherein the base station selection unit transmits downstream data addressed to the moving vehicle from the backbone network to one or more of the base stations of the array; and wherein the vehicle selection unit determines whether the same downstream data was received redundantly by two or more of the base stations, and discards said redundantly-received downstream data, and transmits the downstream data to the moving vehicle.

22. A communication method for communicating signals between a moving vehicle and a backbone network via an array of base stations, the method comprising:

transmitting downstream data addressed to a vehicle selection unit of the moving vehicle from the backbone network to one or more of the base stations of the array;

receiving the downstream data from the one or more base stations and determining whether other downstream data addressed to other moving vehicles was also transmitted to the vehicle selection unit by the one or more base stations;

discarding said other downstream data; and selecting the downstream data addressed to the moving vehicle.

23. A communication method for communicating signals between a moving vehicle and a backbone network via an array of base stations, the method comprising:

transmitting downstream data addressed to the moving vehicle from the backbone network to one or more of the base stations of the array;

determining whether the same downstream data was received redundantly by two or more of the base stations;

discarding said redundantly-received downstream data; and transmitting the downstream data to the moving vehicle.

24. A vehicle selection unit for use in a communication system, which communication system communicates signals between a moving vehicle and a backbone network via an array of base stations, and in which communication system a base station selection unit transmits downstream data addressed to the moving vehicle from the backbone network to one or more of the base stations of the array, the vehicle selection unit comprising:

a receiving/selecting unit that receives the downstream data from the one or more base stations and determines whether other downstream data addressed to other moving vehicles was also transmitted to the vehicle selection unit by the one or more base stations, and discards said other downstream data and selects the downstream data addressed to the moving vehicle.

25. A vehicle selection unit for use in a communication system, which communication system communicates signals between a moving vehicle and a backbone network via an array of base stations, and in which communication system a base station selection unit transmits downstream data addressed to the moving vehicle from the backbone network to one or more of the base stations of the array, the vehicle selection unit comprising:

a determining/selecting unit that determines whether the same downstream data was received redundantly by two or more of the base stations, and discards said redundantly-received downstream data, and transmits the downstream data to the moving vehicle.

26. A communication system for communicating signals between a moving vehicle and a backbone network via an array of base stations, each array defining an array area, which array areas together form a service area of the communications system, the communication system comprising:

a vehicle selection unit and a base station selection unit;

wherein the vehicle selection unit transmits upstream data addressed to the backbone network from the moving vehicle to one or more of the base stations of the array using an upstream signal frequency allocated to the moving vehicle;

wherein the vehicle selection unit receives downstream data from the one or more base stations via a downstream signal frequency common to the array of base stations; and wherein the upstream signal frequency and the downstream signal frequency are allocated according to the array areas forming the service area of the communication system.

* * * * *